United States Patent [19]

Allen

[11] 4,193,501

[45] Mar. 18, 1980

[54] ENVELOPE ASSEMBLY

[75] Inventor: Robert H. Allen, North Tonawanda, N.Y.

[73] Assignee: Moore Business Forms, Inc., Grand Island, N.Y.

[21] Appl. No.: 835,959

[22] Filed: Sep. 23, 1977

[51] Int. Cl.[2] ..... B65D 27/34; B65D 27/10

[52] U.S. Cl. ..... 206/610; 206/620; 206/632; 229/69

[58] Field of Search ..... 206/610, 611, 620, 605, 206/609, 632; 229/69

[56] References Cited

U.S. PATENT DOCUMENTS

| | | | |
|---|---|---|---|
| 211,725 | 1/1879 | Foster | 206/610 |
| 780,883 | 1/1905 | Hinchman | 206/620 |
| 890,538 | 6/1908 | Stillwell | 206/610 |
| 910,862 | 1/1909 | Ritchie | 206/610 |
| 2,056,472 | 10/1936 | Lewis | 206/610 |
| 3,111,255 | 11/1963 | Skowronski | 206/611 |
| 3,451,539 | 6/1969 | Wysocki | 206/620 |
| 3,554,438 | 1/1971 | Van Malderghem | 229/69 |
| 3,620,441 | 11/1971 | Robbins | 206/620 |
| 3,650,463 | 3/1972 | Christiansen et al. | 206/610 |

FOREIGN PATENT DOCUMENTS

| | | | |
|---|---|---|---|
| 159599 | 8/1903 | Fed. Rep. of Germany | 206/610 |
| 469192 | 7/1914 | France | 206/610 |
| 19288 | 8/1914 | France | 206/610 |
| 536595 | 12/1955 | Italy | 206/610 |

*Primary Examiner*—Stephen P. Garbe

*Attorney, Agent, or Firm*—Watson, Cole, Grindle & Watson

[57] ABSTRACT

A stuffed, sealed envelope assembly has superimposed front and back plies with insert material within the envelope removably attached thereto along at least one marginal edge of the insert. At least one cut line or a line of perforations is provided in only one of the envelope plies in the vicinity of another marginal edge of the insert to facilitate opening of the envelope for exposing the insert for extraction. An outline of a simulated flap is applied to the outer surface of the one envelope ply so as to overlie or be delimited by the cut line or the line of perforations. Other seam lines may be applied to the same outer surface so as to give the impression, together with the flap outline, of a folded-flap envelope construction which is capable of being opened for exposing the insert in a manner similar to that of a folded envelope.

Alternatively, superimposed lines of perforations defining a removable tear strip are provided in the plies along a marginal edge thereof between such marginal edge and an edge of the insert material, lying adjacent thereto, other than the edge along which the insert material is connected to the plies. The envelope assembly is thus opened for exposing the insert upon removal of the tear strip similarly as in a folded-flap envelope construction.

8 Claims, 18 Drawing Figures

ENVELOPE ASSEMBLY

BACKGROUND OF THE INVENTION

This invention relates generally to a stuffed, sealed envelope assembly of outer plies containing an insert removably attached thereto along a line of weakening, and more particularly to such an assembly which simulates a standard folded-flap construction which is capable of being opened for exposing the insert for extraction in a manner similar to that of such a standard folded-flap envelope.

U.S. Pat. No. 3,554,438, commonly owned herewith, discloses a stuffed, sealed envelope assembly comprised of superimposed outer plies containing an insert removably attached thereto along a line of weakening. Both outer plies have superimposed lines of weakening extending along an edge opposite the edge at which the insert is attached, such superimposed lines lying inwardly of a free edge of the insert and defining a removable tear strip. Thus, upon removal of the tear strip by a grasp and snap action as the tear strip is held with one hand and the opposite end of the assembly is held with the other hand, the insert is freed from its attachment and is extracted from the envelope.

If the insert, during extraction, separates from the outer plies along its line of weakening as intended, the insert is extracted without difficulty. However, the recipients of such envelope assemblies may be confused as to precise manner in which they are to be opened. A general unfamiliarity with the opening of a stuffed, sealed envelope assembly of this type may result in mutulation of some portion of the envelope assembly including the insert in an attempt to open the envelope similar to that of a folded-flap envelope construction.

In a related application filed June 24, 1977 under U.S. Ser. No. 809,922, and commonly owned herewith, a stuffed, sealed envelope assembly having a free and unattached insert disposed between the outer plies thereof is constructed in such a manner as to permit the envelope to be opened in the manner similar to that of a folded-flap envelope.

SUMMARY OF THE INVENTION

It is therefore an object of the present invention to provide a stuffed, sealed envelope construction which offers the advantages of an envelope constructed generally as shown in U.S. Pat. No. 3,554,438, while at the same time may be opened in a manner familiar to the ordinary addressee, similar to that of the well-known folded-flap envelope.

The stuffed, sealed envelope assembly according to the invention has an insert contained in a pocket defined between superimposed outer envelope plies and removably attached thereto by a line of weakening provided along a marginal edge of the insert. Means are provided in only one of the outer envelope plies adjacent one of the marginal edges of the plies for opening the pocket and exposing the insert for extraction therefrom, such means including at least one cut line extending through such one ply and defining a pocket access opening. Such cut line lies adjacent a free marginal edge of the insert and partially delimits a portion of the one envelope ply which may be separated along the one marginal edge of the plies from the remainder of the one ply upon insertion of an opener through such access opening. A plurality of perforations defining access openings may likewise be provided in the one outer envelope ply such that the cut line and/or the perforations delimit at least a portion of a simulated flap which overlies the free edge of the insert. Various types of perforation lines alone or together with a cut line or cut lines may be provided to facilitate envelope opening, one or more of such lines outlining a simulated flap, or such a flap overlying one or more of such lines. Seam lines are also applied to the outer surface of the one ply so that, together with the flap outline, a folded-flap envelope is simulated.

An optional construction of the present envelope assembly includes superimposed lines of perforations in the outer envelope plies lying between a free edge of the insert and an adjacent free marginal edge of the plies so as to define a tear strip which, upon removal, opens the envelope and exposes the insert for extraction similar to that of a fold-flap envelope whereupon a slight tug on the insert breaks the attachment along its line of weakening and permits easy extraction.

Other objects, advantages and novel features of the invention will become more apparent from the following detailed description of the invention when taken in conjunction with the accompanying drawings.

DETAILED DESCRIPTION OF THE INVENTION

Figure 1:
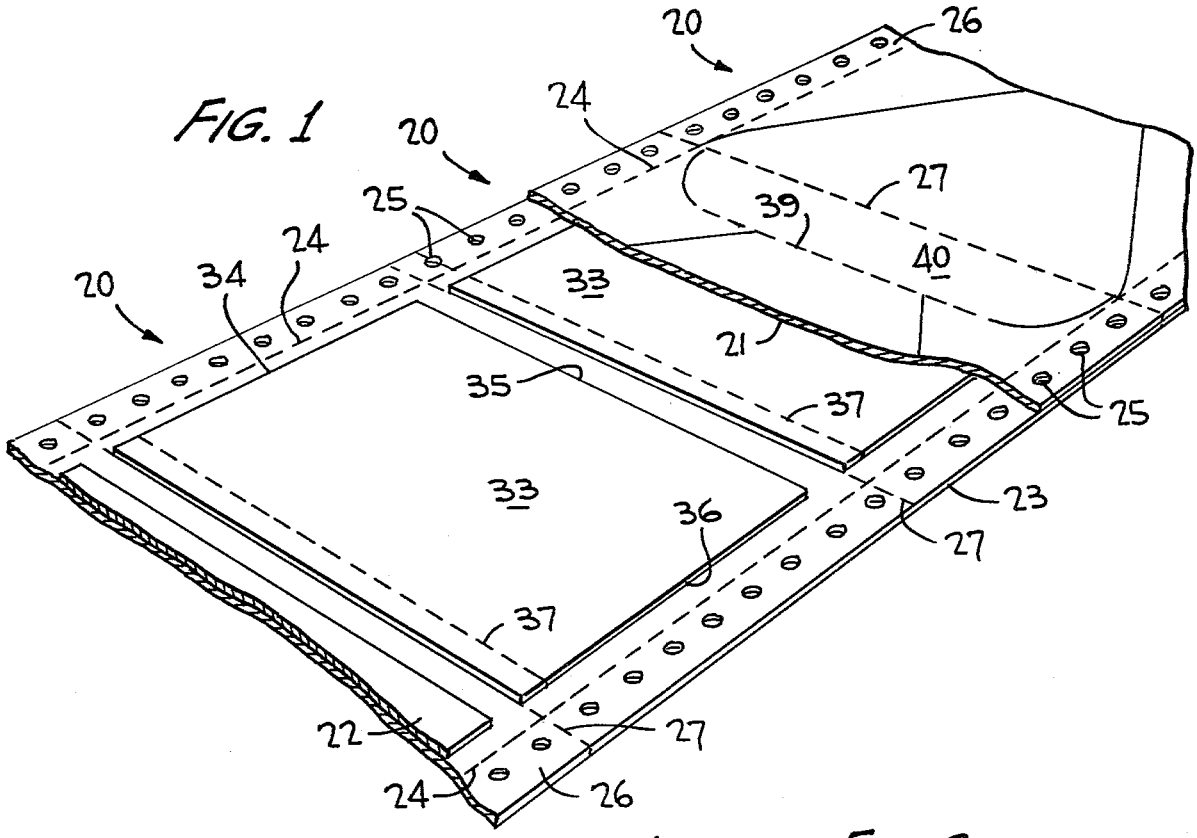
FIG. 1 is a perspective view of a series of connected envelopes constructed in accordance with the invention, a portion thereof being broken away for clarity.
Figure 3:
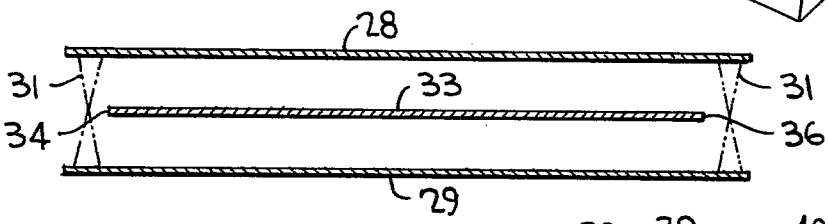
FIGS. 3 and 4 are sectional views taken respectively along lines 3—3 and 4—4 of FIG. 2.
Figure 4:
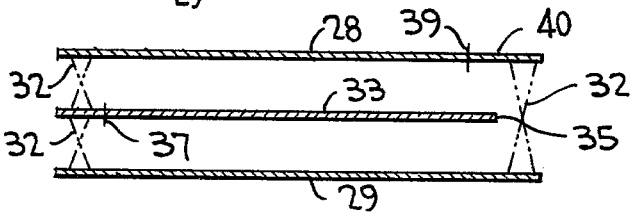

Turning now to the drawings wherein like reference characters refer to like and corresponding parts throughout the several views, a continuous series of connected envelopes each generally designated 20 is shown in FIG. 1 as constructed of continuous superimposed sheets 21, 22 and 23 with sheets 21 and 23 having superimposed longitudinal lines 24 of weakening therein near opposite side edges as well as spaced feed holes 25 defining feed bands 26 removable along lines 24. Superimposed transverse lines 27 of weakening separate the outer sheets into individual envelope assemblies having lower and upper envelope plies 28 and 29 respectively defining back and front envelope panels, adhesively secured together along opposite sides by lines 31 of adhesive (FIG. 3) and adhesively secured together along the remainder of the periphery partially via insert sheet 33 as along lines 32 of adhesive (FIG. 4). It should be observed that the lower envelope plies are designated 28 and are illustrated as uppermost in the drawings to facilitate the description of the envelope opening means according to the invention which is located on the back surface of the envelope and simulates a a folded-flap construction as intended.

Insert sheets 33 are formed from ply 22 by appropriate diecuts along three sides to form free insert edges 34, 35 and 36. The remaining edge of the insert is adhesively secured as at 32 to the outer envelope plies and is rendered removable therefrom along line 37 of weakening presenting substantially weak connecting ties for immobilizing the insert in place during the envelope processing operation. Additional insert sheets, or other insert material in the form of a return envelope or envelopes, may be similarly contained within outer plies 28 and 29 without departing from the scope of the present invention. And, carbon transfer material may be disposed between all or selected portions of the insert parts and plies, or carbonless transfer material may be coated on all or part of the mating surfaces of the insert parts or plies for transferring indicia from upper ply 29 to the assembly.

Figure 2:
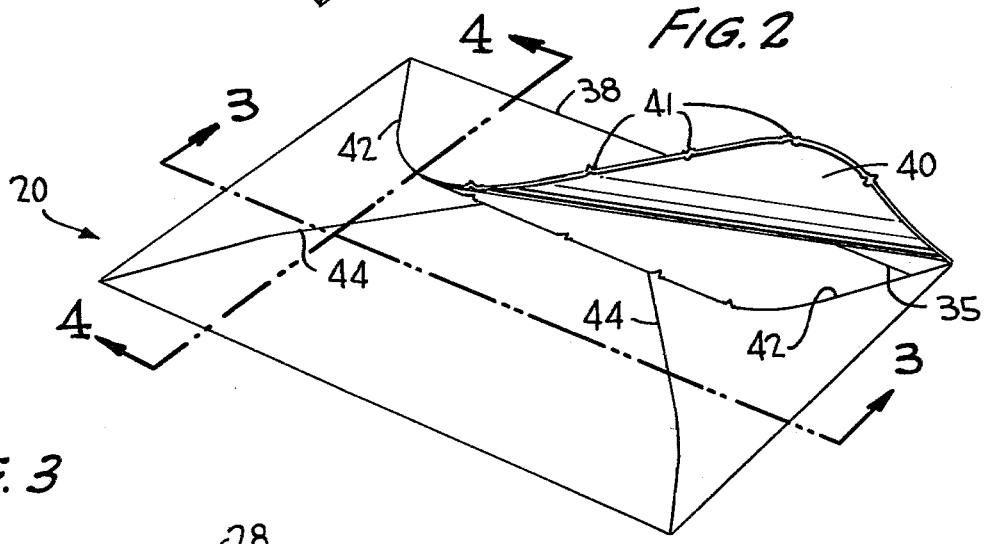
FIG. 2 is a slightly enlarged perspective view of a single envelope assembly separated from the series of FIG. 1 and with the feed bands removed, showing the process of opening the envelope in accordance with the invention.
Figure 5:
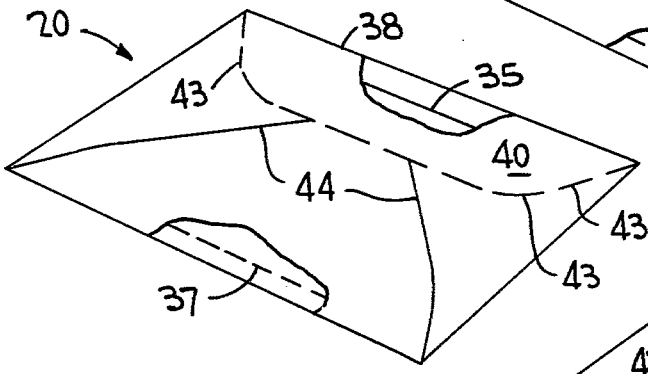
FIG. 5 is a view similar to FIG. 2 showing a slight modification thereof.
Figure 6:
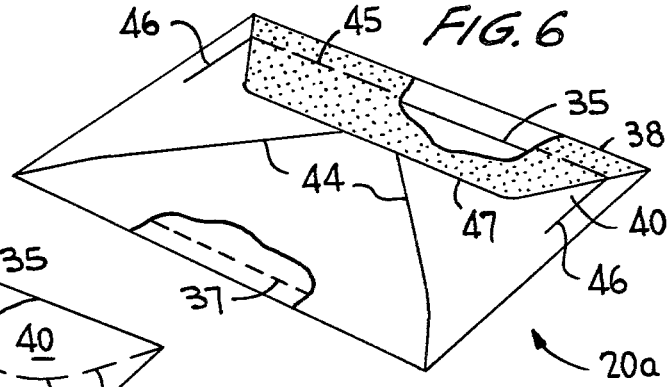
FIGS. 6 to 15 are perspective views of other embodiments according to the invention shown partly broken away for viewing portions of the inserts.

In accordance with the invention, plies 28 of each assembly are provided with means for opening the envelope and exposing the insert for extraction, with such means together with other indicia being applied to the outer surfaces of each ply 28 giving each envelope assembly 20 the appearance of a folded-flap envelope. Such a means comprises a portion 40 of ply 28 (FIG. 2) extending alone a marginal edge 38 of the envelope. Portion 40 is delimited by a line 39 of perforations presenting keen connecting ties 41 (FIG. 2), and is further delimited by continuous cut lines 42 extending from opposite ends of line 39 toward marginal edge 38 as shown in FIGS. 1 and 2. Alternatively, portion 40 may be delimited by a continuous line 43 of perforations having curved ends as shown in FIG. 5. Portions 40 of FIGS. 2 and 5 are otherwise secured in place with the outer ply 29 along line 32 of adhesive (FIG. 4). Cut lines 42 are illustrated as slightly curved although they may be straight if desired. And, only one of such cut lines may be provided, the other cut line 42 being replaced by an extension of line 39 of weakening.

As in the aforementioned related application Serial No. 809,922, lines 39 and 42 or line 43 outline a simulated flap extending along marginal edge 38. Span lines 44 are applied by inking or in any other normal manner to the outer surface of ply 28 and extend from line 39 or 43 so as to simulate, together with the outline of the simulated flap, a folded-flap envelope construction of a typical top opening correspondence envelope.

Curved cuts 42 (FIG. 2) as well as curved cuts 43' (FIG. 5) define access openings as well as lift tabs lying in the same plane as their respective outer plies 28. Accordingly, the stuffed, sealed envelope assembly of the invention may be opened upon insertion of the addressee's thumb or forefinger through any one of these cuts so that, as portion 40 is partly lifted it may be separated along lines 39 or 43 so as to break the connecting ties. It may be then bent upwardly along upper glue line 32, as shown in FIG. 2, thereby exposing edge 35 of the insert. A portion of the insert adjacent this edge may then be grasped and, with a slight outward tug, the insert may be extracted from its envelope as the weak connecting ties along line 37 of perforations are broken. Alternatively, a letter opener may be inserted through one of the access openings defined by the aforementioned cuts to facilitate breaking of the connecting ties at portion 40 as the opener is moved along line 39 or line 43. Otherwise, the letter opener or the addressee's thumb or forefinger may be inserted through one of the access openings and moved along top line 32 of adhesive at marginal edge 38 to facilitate separation of portion 40 from ply 29. Another alternative to opening the envelope, would be to peel away portion 40 or to tear some other portion of ply 28 after access is gained through one of the cuts as aforedescribed.

Other embodiments of the stuffed, sealed envelope assembly according to the invention are illustrated in FIGS. 6 through 15 which each show a slightly different means for opening the envelope and exposing the insert for extraction. Envelope assembly 20*a* of FIG. 6 includes a line 45 of perforations lying parallel to and between marginal edge 38 of the envelope and free edge 35 of the insert, and delimiting part of portion 40. Cut lines 46 in outer play 28 of this envelope extend perpendicularly away from opposite ends of line 45 so as to delimit portion 40 together therewith. An outline 47 of a simulated flap extends along marginal edge 38 and is printed or otherwise applied to the outer surface of ply 28 so that, together with seam lines 44, the back of a folded-flap envelope is simulated. Portion 37 of the FIG. 6 construction may lie at least partially within outline 47 which may include stippling or merely lines forming the simulated flap. Also, a line of perforations may be substituted for either or both cuts 46.

These cuts 46 provide access openings through which the addressee's thumb or forefinger or a letter opener may be inserted for movement along line 45 so as to break the connecting ties thereat. Edge 35 of the insert is then exposed for extraction of the insert as it is grasped and snapped outwardly so as to break the connecting ties along its line 37 of perforations. During the opening process portion 40 may otherwise be completely removed from the envelope by separating it along line 45 and tearing it elsewhere between cuts 46. Alternatively, line 45 could be eliminated and lines 46 extended to edge 38 whereupon plies 28 and 29 would then be secured together at edge 38 along a line of fugitive or releasable glue so as to facilitate easy separation of the plies along edge 38.

Figure 7:
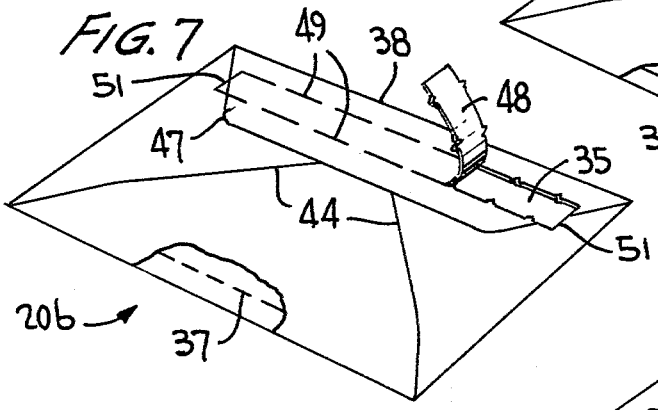

Another embodiment 20*b* is shown in FIG. 7 as having a tear strip 48 provided in only ply 28 thereof and delimited by a pair of spaced lines 49 of perforations with cut lines 51 spanning lines 49 at opposite ends thereof. This tear strip overlies top edge 35 of the insert so as to expose same when the strip is peeled away. These cut lines 51 lie perpendicular to marginal edge 38 and, as in FIG. 6, short lines of perforations could be substituted instead. Also, that line 49 of perforations lying nearest edge 38 could be eliminated and lines 51 could be extended to edge 38. Plies 28 and 29 would then be fugitively (releasably) secured together along edge 38 thereby defining a tear strip delimited by such edge for removal by peeling it away similarly as shown in FIG. 7. And, flap outline 47 substantially surrounds the tear strip so that, together with seam lines 44, a folded-flap envelope is simulated for the back surface of assembly 20*b*.

Figure 8:
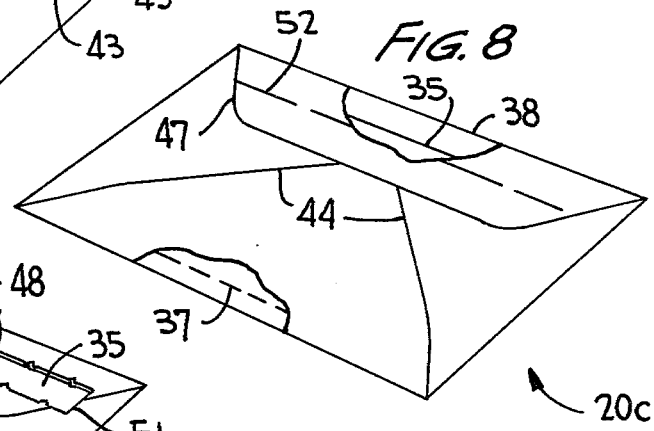

Envelope assembly 20*c* of FIG. 8 is provided with a line 52 of perforations in only ply 28 along marginal edge 38, such line lying slightly outwardly of edge 35 of the insert. An outline 47 of a simulated flap extends along edge 38 and substantially surrounds line 52 of perforations. And, seam lines 44 are applied to the outer surface of ply 28 similarly as described before so that, together with flap outline 47, a folded-flap envelope is simulated. Any one of the cuts defined by line 52 of perforations presents an access opening for insertion of the addressee's thumb or forefinger, or a letter opener so that, upon the application of a force directed along line 52, the connecting ties thereat can be broken in the process of opening the envelope. The insert is therefore exposed and may be easily extracted similarly as described for the foregoing embodiments.

Figure 9:
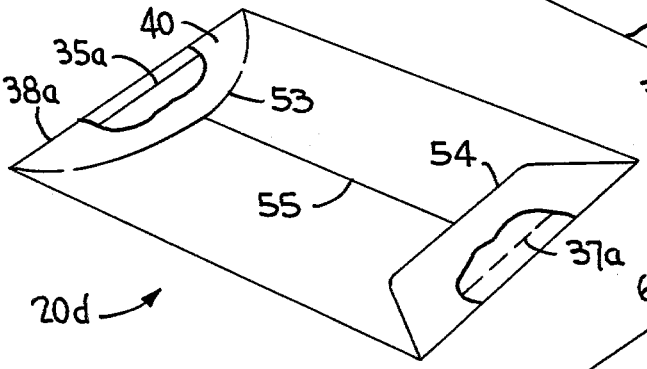

Envelope assembly 20*d* of FIG. 9 is constructed similarly as in FIG. 5 except that separable portion 40 in only ply 28 overlies a free edge 35*a* of the insert along a short side thereof, portion 40 being delimited by marginal edge 38*a* of the envelope and a curved line 53 of perforations. Line 53 simulates an envelope flap, and an outline 54 is printed or otherwise applied to the outer surface of ply 28 at an end opposite portion 40 so as to overlie the marginal edge of the insert connected to the outer plies of the envelope as at 37*a*. A seam line 55 is also applied to the outer surface of ply 28 and spans lines 53 and 54 so that, together with these lines, a folded-flap envelope is simulated. Envelope assembly 20*d* may be opened similarly as described with reference to FIG. 5 for exposure of the insert for extraction.

Figure 10:
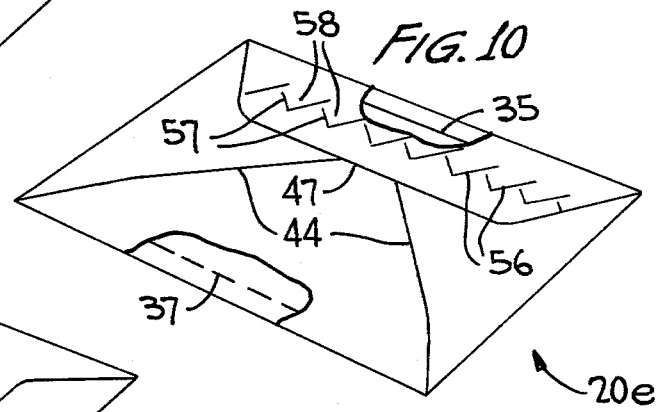

FIG. 10 illustrates another envelope assembly 20*e* as having in only ply 28 thereof a plurality of short diagonal cuts or perforations 56 sloping in one direction along marginal edge 38, and a plurality of shorter diagonal cuts 57 sloping in an opposite direction in portions 58 located between adjacent cuts 56. An opener such as the addressee's thumb or forefinger, or a letter opener, may be inserted through one of the cuts 56 defining access openings for tearing portions 58 of this outer ply along cuts 56 and 57. The insert is therefore exposed for extraction upon such tearing. Outline 47 is applied in any normal manner to the same outer surface of the envelope so as to simulate, together with seam lines 44, a folded-flap envelope.

Figure 11:
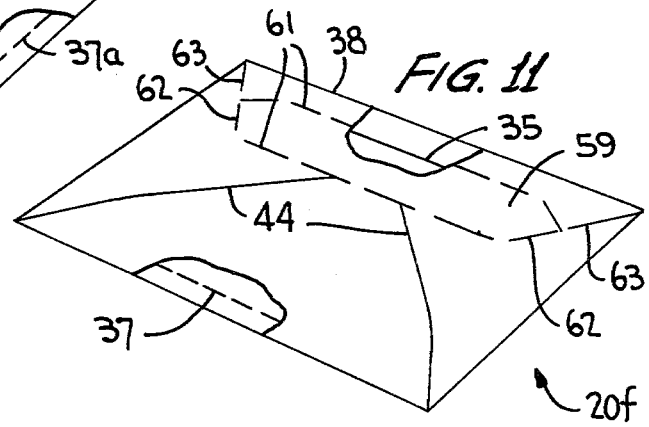

Envelope assembly 20*f* of FIG. 11 is similar to envelope assembly 20*b* of FIG. 7 in that tear strip 59 overlies free edge 35 of the insert adjacent marginal edge 38 of the envelope, and is delimited by a pair of spaced lines 61 of perforations. However, this tear strip is further delimited by substantially V-shaped lines 62 of perforations at opposite ends thereof. Short cuts 63 extend toward marginal edge 38 so as to outline, together with portions of lines 61 and 62, a simulated top flap for the envelope. Access to the interior of the envelope can be made through any one of the openings defined by cuts 63 and by lines 61 and 62 of perforations, or tear strip 59 may be peeled away upon insertion of a letter opener or the addressee's thumb or forefinger through one of the cuts of lines 61 or 62. Again, seam lines 44 are likewise applied to the outer surface of ply 28 of this construction so as to further simulate a folded-flap envelope.

Figure 12:
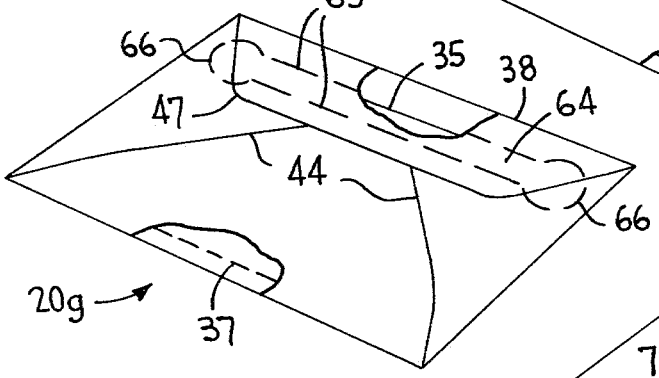

Envelope assembly 20*g* of FIG. 12 is likewise similar to assembly 20*b* of FIG. 7 in that a tear strip 64 in only ply 28 overlies edge 35 of the insert adjacent marginal edge 38 of the envelope and is delimited in part by a pair of spaced parallel lines 65 of perforations. However, in this construction, lines 65 are connected at opposite ends by curved lines 66 of perforations. As in the foregoing constructions, the perforations are defined by cuts of sufficient size as to provide access openings for the insertion of a letter opener or some other object such as the addressee's finger for facilitating removal of the tear strip along its lines of perforations, or for otherwise tearing the envelope along marginal edge 38 or elsewhere. The tear strip is contained at least in part within an outline 47 simulating a top flap, and other seam lines 44 are likewise applied to the outer surface of ply 28 for the same purpose as intended with respect to the other described embodiments.

Figure 13:
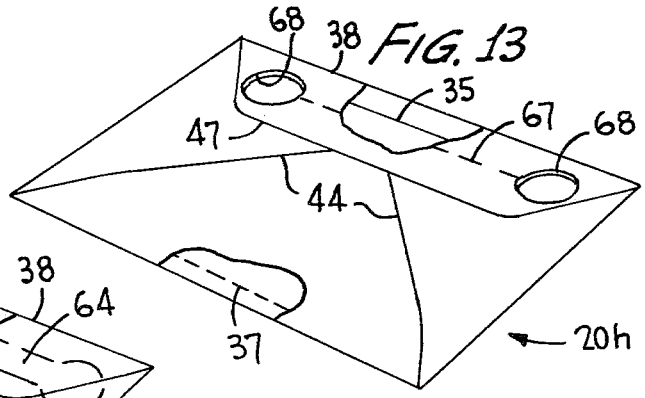

Envelope assembly 20*h* is shown in FIG. 13 as having a means for opening the envelope and exposing the insert, which means is defined by a line 67 of perforations in only ply 28 lying parallel to marginal edge 38 slightly inwardly of free edge 35 of the insert with circular openings 68 provided in only outer ply 28 of the envelope at opposite ends of line 67. Such openings, therefore, provide access openings for a letter opener or the like so as to facilitate opening of the envelope as it is separated along line 67 or along some other portion of the envelope as, for example, marginal edge 38. Flap outline 47 surrounds line 67 and openings 68 so that, together with seam lines 44, a folded-flap envelope is simulated.

Figure 14:
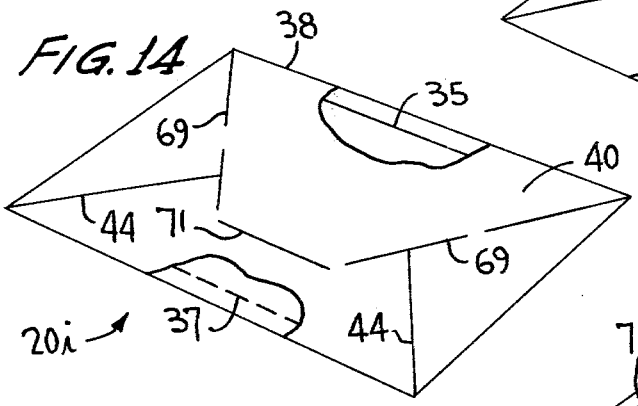

Envelope assembly 20*i* shown in FIG. 14, is similar to envelope 20 of FIGS. 2 and 5 except that substantially straight cuts 69 and 71 are provided in outer ply 28 of the envelope and together outline a large top flap defining portion 40 which may be lifted away from the envelope or otherwise torn similarly as described in FIGS. 2 and 5. And, seam lines 44 are applied to the outer surface of ply 28 of this envelope so as to further simulate a folded-flap envelope.

Figure 15:
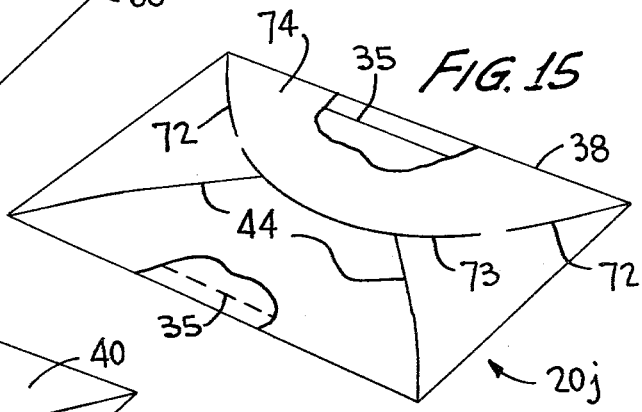

An envelope assembly 20*j* is shown in FIG. 15 as having cuts 72 in only ply 28 extending inwardly from marginal edges 38 and, together with a curved line 73 applied to the outer surface of ply 28, outline a simulated envelope flap. Cuts 72 define access openings for the insertion of the operator's finger, a letter opener, or similar other opening object so that portion 74 of this envelope may be separated from the remainder thereof by tearing between cuts 72 and/or along edge 38. Various combinations of straight and/or curved lines of perforations outlining portion 74 may be used in this embodiment, and in any of the aforedescribed embodiments wherein such lines outline a simulated envelope flap.

Figure 16:
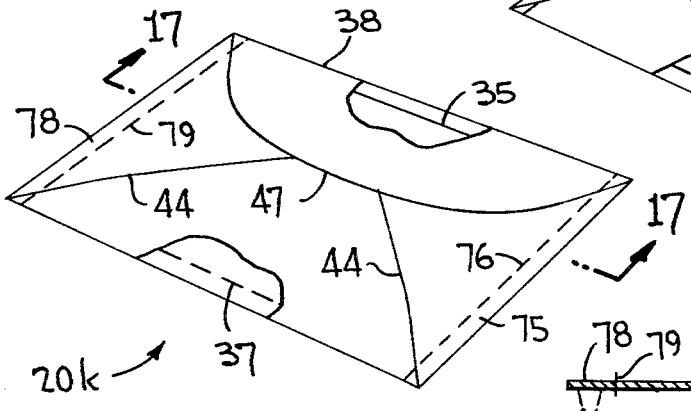
FIG. 16 is a perspective view of yet another embodiment according to the invention, partly broken away.
Figure 17:
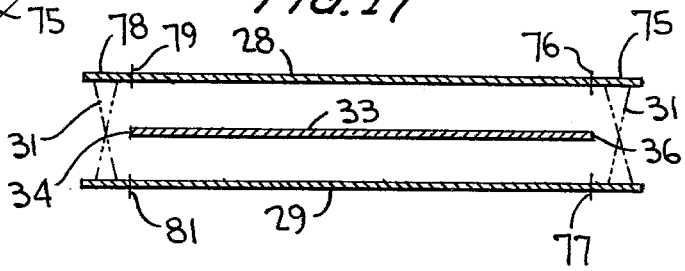
FIG. 17 is a sectional view taken substantially along lines 17—17 of FIG. 16.

FIGS. 16 and 17 illustrate another means for opening the envelope and exposing the insert for extraction therefrom. The envelope assembly, generally designated 20*k*, contains an insert sheet 33 connected to the outer envelope plies at one edge as along line 37 of perforations. Outer plies 28 and 29 are adhesively secured together along all four sides, similarly as in the FIG. 2 construction, and the insert sheet is free of attachment along its marginal edges 34, 35 and 36. However, the means for opening the envelope and exposing the insert for extraction comprises a removable tear strip 75 located at one end of the envelope and defined by superimposed lines 76 and 77 of perforations provided in outer plies 28 and 29. Free edge 36 of the insert extends, at the most, in superposition with lines 76 and 77. Therefore, upon removal of tear strip 75, the addressee may then reach in and extract the insert by giving it a slight outward tug sufficient to break the weak connecting ties along line 37.

An additional removable tear strip 78, defined by superimposed lines 79 and 81 of perforations in plies 28 and 29, may likewise be provided if desired along an opposite end of the envelope. Free edge 34 of the insert is aligned with, or lies slightly inwardly of lines 79 and 81 so that, upon removal of tear strip 78, the insert may be extracted as it is grasped and given a slight outward tug sufficient to break the weak connecting ties along line 37. Envelope assembly 20*k* may, therefore, be opened and the insert exposed for extraction from either end of the envelope similarly as in a folded-flap construction. And, flap outline 47 and seam lines 44 are applied to the outer surface of ply 28 for simulating a standard folded-flap correspondence assembly.

Figure 18:
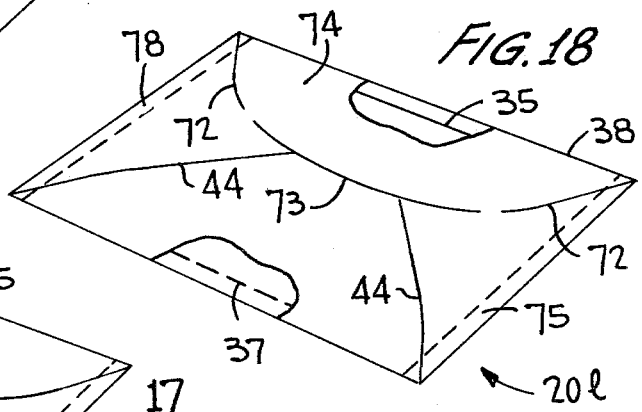
FIG. 18 is a perspective view of still another embodiment according to the invention, partly broken away.

Another stuffed, sealed envelope assembly 20*l* is shown in FIG. 18 constructed similarly as assembly 20*k* but further provided with cuts 72 and a curved line 73 similar to that shown in FIG. 15. Hence, the envelope may be opened and the insert exposed for extraction either as described with reference to FIGS. 16 and 17 or with reference to FIG. 15, i.e., either by the removal of tear strips 75 or 78 or upon a tearing of portion 74 similarly as described for opening envelope assembly 20*j*.

From the foregoing, it can be seen that the stuffed, sealed envelope assemblies of the embodiments herein disclosed may be quickly processed through the assembling and printing stages by being series-connected together, yet the individual envelope assemblies simulate folded-flap envelopes and are capable of being opened as such. The inserts are easily extracted upon envelope opening by exerting a slight outward tug thereon to break the connecting ties lying along line 37 of perforations.

Although insert 33 is illustrated throughout the several embodiments as being removably attached to the envelope plies along a line 37 of weakening, it should be appreciated that the insert may be similarly attached along one or more of its other edges without departing from the scope of the invention.

Obviously, many modifications and variations of the invention are made possible in light of the above teachings. It is therefore to be understood that within the scope of the appended claims, the invention may be practiced otherwise than as specifically described.

I claim:

1. A stuffed, sealed envelope assembly, comprising, superimposed front and back plies, adhesive means securing said plies together along marginal edges thereof to form an envelope pocket within the assembly, insert material disposed within said pocket and being removably attached along one marginal edge thereof to said plies, means lying adjacent one of said marginal edges of said plies for opening said pocket and exposing said insert material for extraction therefrom, said means comprising at least one cut line extending through only one of said plies and defining a pocket access opening, said cut line lying near one end of another marginal edge of said insert material, said adhesive means securing said plies together along said one marginal edge thereof comprising a stream of releasable glue to thereby further comprise said means for opening and exposing, said cut line partially delimiting a portion of said one ply which may be separated along said another marginal edge from the remainder of said one ply upon insertion of an opener through said access opening, the other of said plies being completely devoid of any means facilitating opening of said pocket, whereby said pocket may be opened and said insert material exposed for extraction therefrom as said portion is separated from said remainder of said one ply upon application by the opener of a force causing the separation after the opener is inserted through said access opening.

2. The envelope assembly according to claim 1, wherein said means for opening and exposing comprise a plurality of perforations including said cut line, at least said perforations extending along said another marginal edge between opposite ends thereof, said perforations extending through said one ply and defining pocket access openings, and said perforations permitting said portion to be separated from said remainder of said one ply upon insertion of the opener through one of said access openings, whereby said pocket may be opened and said insert material exposed for extraction therefrom as said portion is separated between said perforations from said remainder of said one ply upon application by the opener of a force causing the separation after the opener is inserted through said one access opening.

3. A stuffed, sealed envelope assembly, comprising, superimposed front and back plies, adhesive means securing said plies together along marginal edges thereof to form an envelope pocket within the assembly, insert material disposed within said pocket and being removably attached along one marginal edge thereof to said plies, means lying adjacent one of said marginal edges of said plies for opening said pocket and exposing said insert material for extraction therefrom, said means being the sole means for opening said pocket and exposing said insert material for extraction therefrom, and said means comprising at least one cut line extending through only one of said plies and defining a pocket access opening, said cut line lying near one end of another marginal edge of said insert material and partially delimiting a portion of said one ply which may be separated along said another edge from the remainder of said one ply upon insertion of an opener through said access opening, said cut line being oriented to outline part of a simulated fold flap along said another edge, and flap lines applied to an outer surface of said one ply for simulating a folded-flap envelope construction, whereby the assembly is devoid of any sealed flaps enclosing said insert material, and whereby said pocket may be opened for exposing said insert material for extraction therefrom only as said portion is separated along said another edge from said remainder of said one ply upon exertion by the opener of a force causing the separation after the opener is inserted through said access opening.

4. The envelope assembly according to claim 3, wherein a fold flap line is applied to said outer surface of said one ply and defines another portion of said simulated fold flap outline.

5. The envelope assembly according to claim 3, wherein said means for opening and exposing comprises a first line of perforations including said cut line and lying along said one marginal edge of said plies between opposite ends of said another edge, said first line of perforations being oriented to outline the simulated fold flap, and said flap lines extending away from said simulated flap outline.

6. The envelope assembly according to claim 3, wherein said means for opening and exposing comprises a pair of spaced cut lines extending through only said one ply and lying along said one marginal edge of said plies at opposite ends of said another edge, said cut lines being oriented to outline part of the simulated fold flap, a fold flap line applied to said outer surface of said one ply defining the remainder of said simulated fold flap outline, and said flap lines extending away from said simulated flap outline.

7. The envelope assembly according to claim 3, wherein a second line of perforations extends through only said one ply and lies along said one marginal edge of said plies, said first and second lines of perforations together defining a tear strip which, when removed, exposes said insert edge for extraction.

8. An assembly formed of superimposed plies having spaced transverse lines of weakening defining a succession of interconnected sealed envelopes, comprising: front and back panels; adhesive means securing said panels together along marginal edges thereof to form an envelope; insert material disposed within said pocket and being removably attached along one marginal edge thereof to said panels, means lying adjacent one of said marginal edges of said panels for opening said pocket and exposing said insert material for extraction therefrom, said means being the sole means for opening said pocket and exposing said insert material for extraction therefrom; and said means comprising at least one cut line extending through only one of said panels and defining a pocket access opening; said cut line lying near one end of another marginal edge of said insert material and partially delimiting a portion of said one panel which may be separated along said another edge from the remainder of said one panel upon insertion of an opener through said access opening; said cut line being oriented to outline part of a simulated fold flap along said another edge, and flap lines applied to an outer surface of said one panel for simulating a folded-flap envelope construction, whereby each sealed envelope is devoid of any sealed flaps enclosing said insert material, and whereby said pocket may be opened for exposing said insert material for extraction therefrom only as said portion is separated along said another edge from said remainder of said one panel upon exertion by the opener of a force causing the separation after the opener is inserted through said access opening.

* * * * *